US007967172B2

(12) United States Patent
Albaum

(10) Patent No.: US 7,967,172 B2
(45) Date of Patent: Jun. 28, 2011

(54) METERED DOSAGE DISPENSER CLOSURE FOR POWDERS

(75) Inventor: Gary J. Albaum, Pleasantville, NY (US)

(73) Assignee: Kraft Foods Global Brands LLC, Northfield, IL (US)

( * ) Notice: Subject to any disclaimer, the term of this patent is extended or adjusted under 35 U.S.C. 154(b) by 659 days.

(21) Appl. No.: 12/028,979

(22) Filed: Feb. 11, 2008

(65) Prior Publication Data

US 2009/0200342 A1 Aug. 13, 2009

(51) Int. Cl.
*B67D 3/00* (2006.01)

(52) U.S. Cl. ..... 222/514; 222/1; 222/181.1; 222/162; 222/449; 222/453; 222/518; 141/353; 141/360

(58) Field of Classification Search ..... 222/500–501, 222/449–450, 453–456, 476, 556, 566, 562, 222/567–568, 162, 181.1, 514, 518; 141/348–355, 141/360, 366
See application file for complete search history.

(56) References Cited

U.S. PATENT DOCUMENTS

| | | | | | |
|---|---|---|---|---|---|
| 538,561 | A | | 4/1895 | Upton | |
| 689,468 | A | | 12/1901 | Dobbyn | |
| 966,270 | A | | 8/1910 | Van Leir | |
| 1,698,732 | A | | 1/1929 | Pasnik | |
| 2,182,878 | A | | 12/1939 | Pipenhagen | |
| 2,186,326 | A | * | 1/1940 | Casorotti | 222/484 |
| 2,437,589 | A | * | 3/1948 | Bink | 222/493 |
| 2,547,744 | A | * | 4/1951 | Burger | 141/360 |
| 2,585,299 | A | | 2/1952 | Cook | |
| 2,603,397 | A | | 7/1952 | Olson | |
| 2,722,345 | A | * | 11/1955 | Van Buren | 222/631 |
| 2,828,893 | A | * | 4/1958 | Stewart et al. | 222/453 |
| 3,061,152 | A | * | 10/1962 | Safianoff et al. | 222/514 |
| 3,232,498 | A | * | 2/1966 | Bennett | 222/449 |
| 3,446,403 | A | | 5/1969 | Serio | |
| 3,731,851 | A | | 5/1973 | Rauh | |
| 3,844,454 | A | | 10/1974 | Buchtel | |
| 3,910,467 | A | | 10/1975 | Nilson | |
| 4,728,011 | A | | 3/1988 | Schuster et al. | |
| 4,993,600 | A | * | 2/1991 | Tucker et al. | 222/321.6 |
| 5,037,007 | A | * | 8/1991 | Deussen | 222/321.6 |
| 5,154,212 | A | | 10/1992 | Weber | |
| 5,186,367 | A | | 2/1993 | Hickerson | |
| 5,649,643 | A | | 7/1997 | Ridgeway | |
| 6,131,774 | A | * | 10/2000 | Thomas et al. | 222/181.2 |
| 6,276,572 | B1 | | 8/2001 | Evans | |
| 7,093,738 | B1 | | 8/2006 | Evans et al. | |
| 7,228,993 | B2 | | 6/2007 | Yang | |
| 2007/0164059 | A1 | | 7/2007 | Rosiello et al. | |

FOREIGN PATENT DOCUMENTS

WO WO 2007/039223 4/2007

* cited by examiner

*Primary Examiner* — Frederick C. Nicolas
(74) *Attorney, Agent, or Firm* — Stites & Harbison PLLC; Marvin Petry; Stephen J. Weyer

(57) ABSTRACT

A dispenser for a container has an annular ring with a central portion which has at least one aperture. The annular ring is attached to a valve dimensioned to close an opening of the dispenser. The valve is operatively associated with the opening and biased in the closed position. Depressing the annular ring acts as an actuator to cause the valve to move inwardly into the container and away from the opening, thereby allowing the contents to be dispensed from the container through the at least one aperture of the annular ring.

26 Claims, 8 Drawing Sheets

METERED DOSAGE DISPENSER CLOSURE FOR POWDERS

FIELD OF THE INVENTION

The present invention relates to a dispenser and, in particular, a closure for dispensing metered dosages of a powder.

BACKGROUND OF THE INVENTION

Powdered beverages come packaged in various containers, depending on consumer preference and use. Conventional containers for powdered beverage mixes include single serving packets, as well as bulk containers. With regard to single serving packets, a user opens a packet and pours its contents into a liquid container, such as a bottle, glass or pitcher, and then adds water to form a liquid beverage. With regard to bulk containers, a user scoops out a desired quantity of the powder and adds it to the liquid container to mix with water therein to form the liquid beverage.

One disadvantage with conventional single serving powder packets is that one is not able to easily customize the amount of powder to be added to the liquid container in order to adjust to a particular container size or a personal taste preference. Further, the single serving packet contains a predetermined amount of powder for a specific serving size, such as the required amount of powder for a 0.5 liter beverage. However, should one wish to make a beverage larger or smaller than 0.5 liters, one either has to estimate and use less than the single serving size packet when making a smaller sized beverage and use more than one packet when making a larger sized beverage. With regard to bulk powder containers, although they provide the flexibility of measuring a varying amount of powder to add to various sized liquid containers, they lack the portability and convenience that single serving packets provide.

Mechanical dispensers have to be used to dispense and meter various powders, such as laundry powder, fertilizer and medicinal powder. One recent powder dispenser is disclosed in U.S. Patent Application Publication No. 2007/0164059, which discloses a powder delivery device for dispensing a clotting agent. The dispenser comprises a housing; a plunger contained in the housing; a gating component comprising a first gate having a closed end, an open end and a second gate; and a metering area between the first gate and the second gate. The gating component permits a predetermined quantity of powdered material to be metered and dispensed.

U.S. Pat. No. 5,154,212 discloses a dispenser for metering and dispensing laundry detergent. The device includes a container with a valve assembly mounted therein. The valve assembly has a valve body including a closure member that is enlarged and conical and that closes the valve aperture of the container. The operating rod is encircled by a sealed spring that holds the valve body in position to close the valve aperture. When the spring is forced into a compressed position, e.g., by bringing the activating knob into contact with a measuring cup, the valve aperture opens and permits laundry agent within the container to flow into the measuring cup when dispensing is desired.

U.S. Pat. No. 3,232,498 discloses a dispenser for metering pre-measured quantities of material, such as tea, sugar and coffee, from a container. Dispensing of the material is controlled by a valve member which is normally biased by a spring. Force against the top of a container causes the valve member to assume a second position, permitting the material to flow into a chamber, but not out of it. Upon return of the valve to the original position, a chamber outlet is opened and the material is free to flow out of the dispenser.

U.S. Pat. No. 2,722,345 discloses a dispenser comprising a container body holding a granular product, a measuring chamber below the container body, and a valve between a container body and the measuring chamber, biased in an open position to allow product to flow into the measuring chamber. The valve selectively opens and closes two passages into and out of the measuring chamber. In its initial position, the valve is biased to open the passage between the container body and the measuring chamber and to close the passage between the measuring chamber and the exterior. Inversion of the dispenser causes a granular product to flow from the container body into the measuring chamber. While inverted, depressing a rod (actuator) attached to the valve closes the opening between the measuring chamber and the container body, preventing additional granular product from flowing into the measuring chamber from the container body from above, and simultaneously opens the passage from the measuring chamber to the exterior, permitting the product in the measuring chamber to be dispensed from the dispenser.

There is a need in the powdered beverage dispensing art for new and improved dispensers for dispensing and metering powdered beverages.

SUMMARY OF THE INVENTION

The present invention relates to a new and improved dispenser for dispensing metered dosages of a powder, such as a powdered beverage. The dispenser is designed to allow a user to controllingly dispense a desired quantity of powder into a liquid container, such as a glass, bottle or pitcher. Advantageously, the dispenser is of a small enough diameter, i.e. "palm sized," to allow one to easily store the dispenser in one's pocket, bag or the like. The dispenser comprises a valve and an actuator attached to the valve which biases the valve in a closed position. The actuator has a center opening. Powder is dispensed from the dispenser by inverting the dispenser and resting the actuator on a rim of a liquid container, such as a glass, bottle or pitcher, with the valve in its biased, closed position over the actuator opening, thus preventing powder from exiting the dispenser. With the actuator opening over the mouth of the liquid container, pressing downward on the actuator moves the valve away from the opening, thereby opening the valve and allowing powder to flow continuously from the dispenser through the actuator opening and into the liquid container disposed below. Metering of the amount of powder dispensed is provided by counting or timing how long the powder is being dispensed (the "flow time") and correlating a known flow rate with the flow time to calculate how much powder has been dispensed. Thus, one can meter a precise amount of powder by dispensing the powder for a predetermined amount of time. Further, one can precisely vary the amount of powder dispensed by dispensing the powder for various preset flow times which correspond with various predetermined powder amounts.

The present invention, in one form thereof, relates to a dispensing device for a container. The dispensing device comprises an opening of the container and an annular ring having a central portion with at least one aperture. The annular ring is attached to a valve dimensioned to close the opening. The valve has a top surface and a side surface; and is operatively associated with the opening and biased in a closed position. Depressing the annular ring causes the valve to move inward, into the container and away from the opening, thereby allowing the contents to be dispensed from the container in a continuous flow, over the top surface of the valve, and through the at least one aperture of the annular ring when the dispenser is inverted.

In one advantageous form, the opening of the container is formed by a mouth of the container and the annular ring surrounds the opening, wherein when the annular ring is depressed inwardly, the annular ring slides down around the mouth of the container, thereby exposing the mouth of the container. The mouth of the container may comprise a pair of channels and the annular ring may comprise a transverse member spanning the central portion of the annular ring, wherein the transverse member is disposed in the pair of channels of the mouth of the container.

In another advantageous form, the annular ring has an exterior wall with a surface abutting an interior facing surface of the container, forming a bearing surface therebetween.

The present invention, in another form thereof, relates to a dispensing container which comprises a container body having an opening at its top and an annular ring surrounding the opening. A plug is disposed in and closes the opening. The plug has a top surface and a side surface. The plug is attached to the annular ring and is biased in a closed position. Depressing the annular ring moves the valve inwardly towards a center of the container, thereby moving the plug away from the opening, allowing the contents of the container to be dispensed in a continuous flow, over the top surface of the plug, through the opening and out through a center portion of the annular ring.

Advantageously, the container is dimensioned to be easily grasped and held in one's hand. For example, the container may have dimensions of one to ten inches in height and a width and depth of one to four inches.

The present invention, in another form thereof, relates to a method for dispensing contents from a container. The method comprises inverting a dispenser having a depressible actuator attached to a valve which closes an opening, pressing the actuator on a surface to open the valve, thereby starting the flow of the contents from the container through the opening, and metering the amount of contents from the dispenser, based on knowing the flow rate of the contents from the container.

In one specific form, metering the amount dispensed comprises timing how long the contents are dispensed from the container and correlating the time to how much of the contents are dispensed, based on a known flow rate.

In one advantageous form, the method comprises pressing the actuator, in the form of an annular ring with center bore, on the mouth of a liquid container therebelow, with the center bore over the liquid container, so that the contents will flow from the dispenser through the center bore of the annular ring and into the liquid container below.

DETAILED DESCRIPTION

Figure 1B:
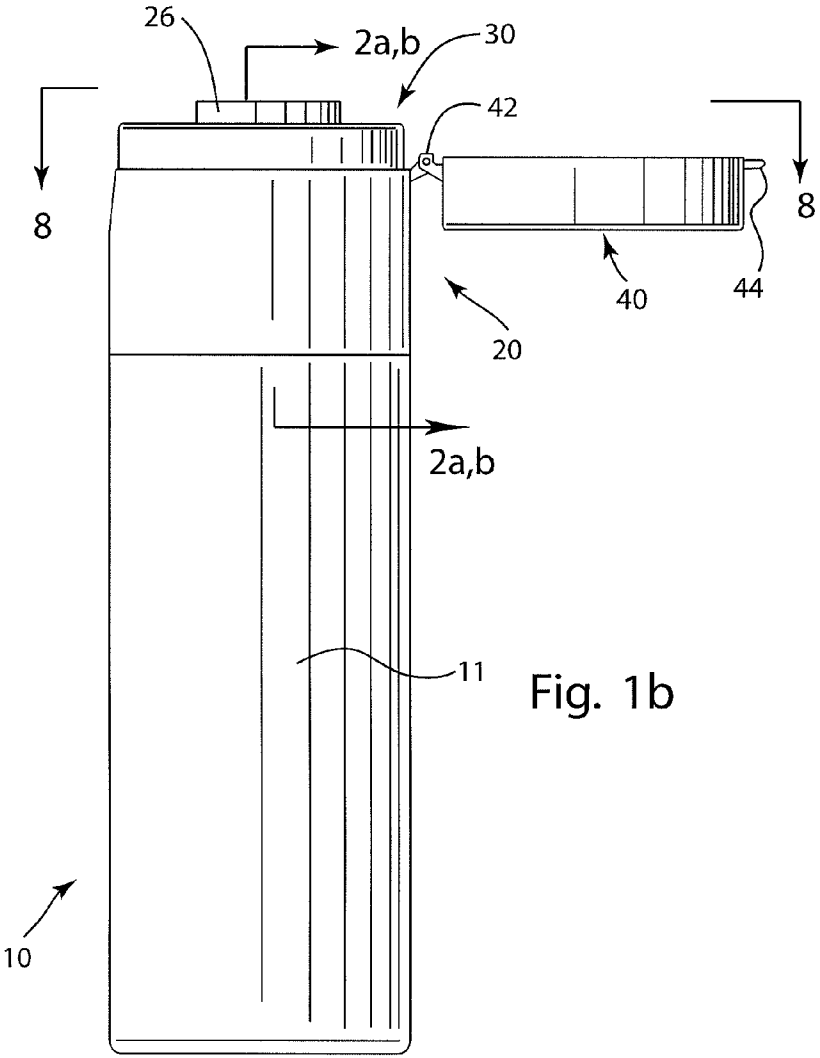
FIG. 1*b* is the container of FIG. 1*a* with the cap, shown in its open position.
Figure 1A:
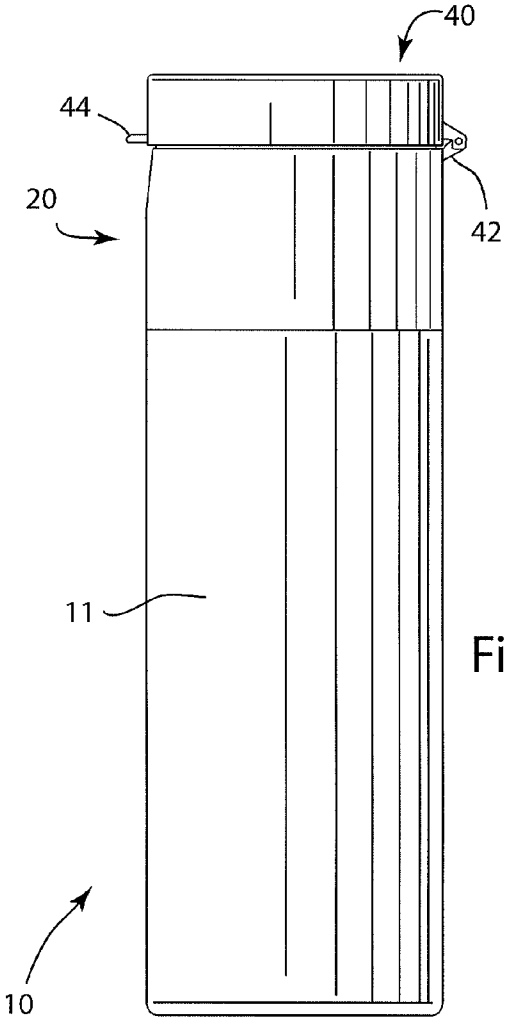
FIG. 1*a* is a side elevational view of a container with dispensing closure with a cap over the dispensing closure, in accordance with the present invention.

Referring now to the drawings and, in particular, FIGS. 1*a* and 1*b*, container 10 comprises container body 11, closure 20 and cap 40. Cap 40 is pivotally attached to the closure 20 via hinge 42. A tab 44 is disposed on the cap 40 which allows one to easily grasp the cap 40 to move the cap 40 away from the top of the closure 20, as shown in FIG. 1*b*. The cap 40 preferably provides a primary moisture seal for the contents of container 10.

Advantageously, container 10 has a height of one to ten inches and a diameter of one to four inches. In alternative forms, if the container is not in the form of a cylindrical body, the width and depth of the container ranges from one to four inches.

Referring now to FIGS. 2-5, closure 20 comprises a base 22, which includes threads 23 which engage with complementary threads (not shown) at the top of container body 11. The base 22 has an angled or conically-shaped wall 24 which leads to a spout 26 having a central bore terminating at an opening 28. A pair of channels 29 extend longitudinally from the opening 28 to approximately where the spout 26 meets the conical portion 24. Base 22 has an interior facing surface 54, facing spout 26.

Although base 22 of closure 20 is depicted as an independent component from the container body 11, alternatively, the base 22 may be integrally formed with, and a part of, the container body 11, and thus not a separate component threadingly engaged with the container body 11. Further, the dispensing closure 20 can be disposed on container bodies having shapes other than cylindrical forms.

Figure 3:
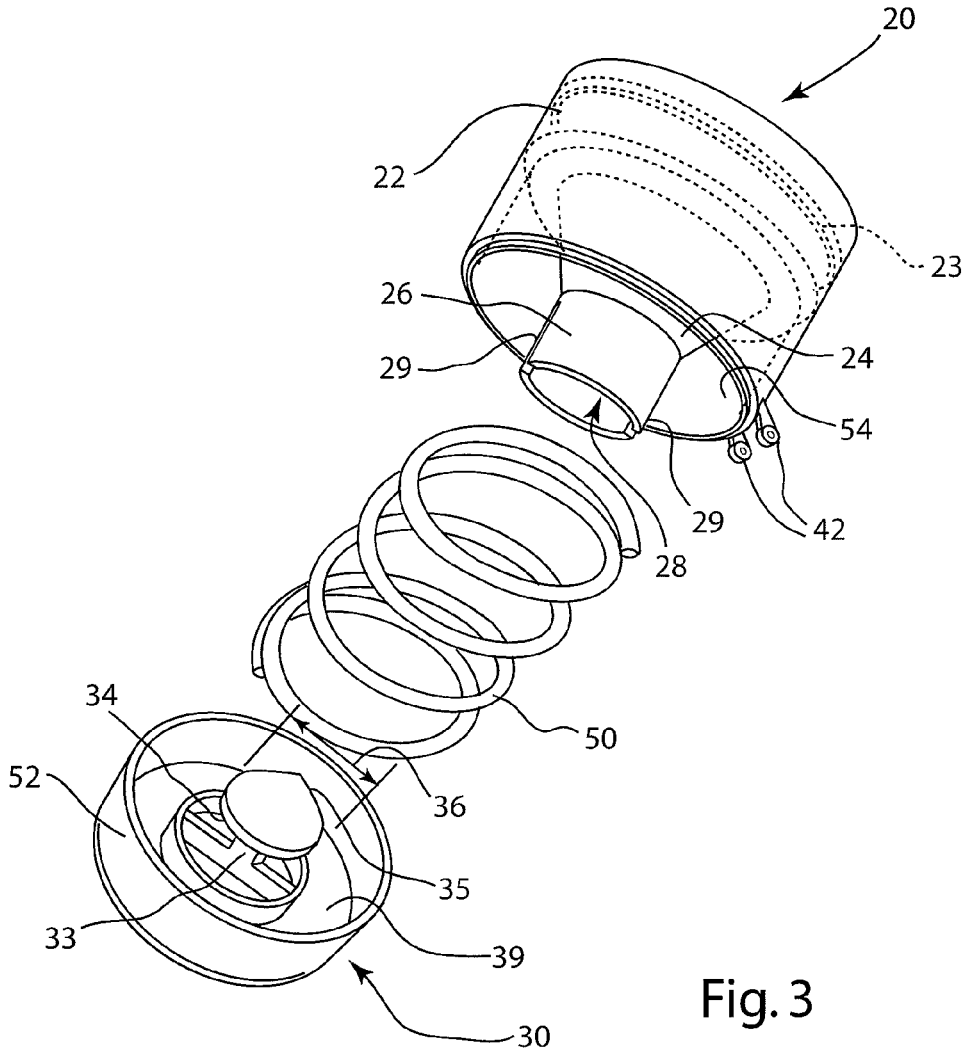
FIG. 3 is an exploded view of the dispensing closure of FIGS. 2*a* and 2*b;*
Figure 4:
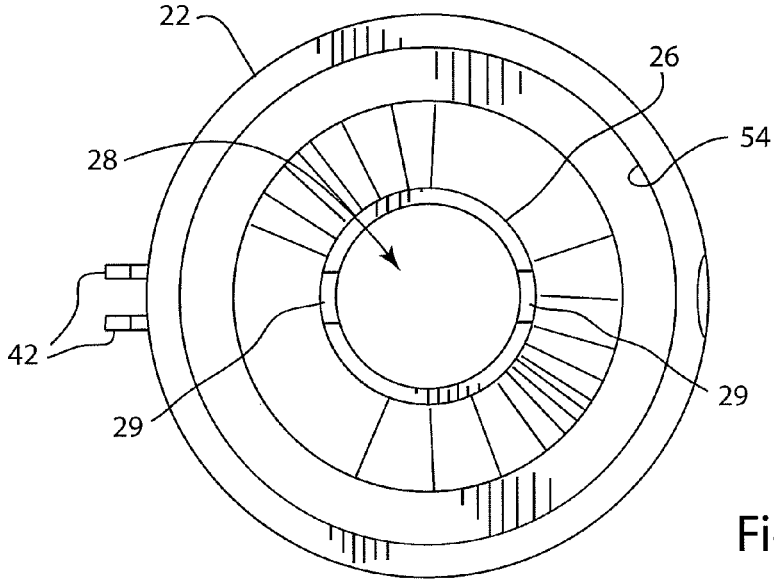
FIG. 4 is a plan view of a base of a closure of the container of FIGS. 2*a* and 2*b*, viewed from below.
Figure 5:
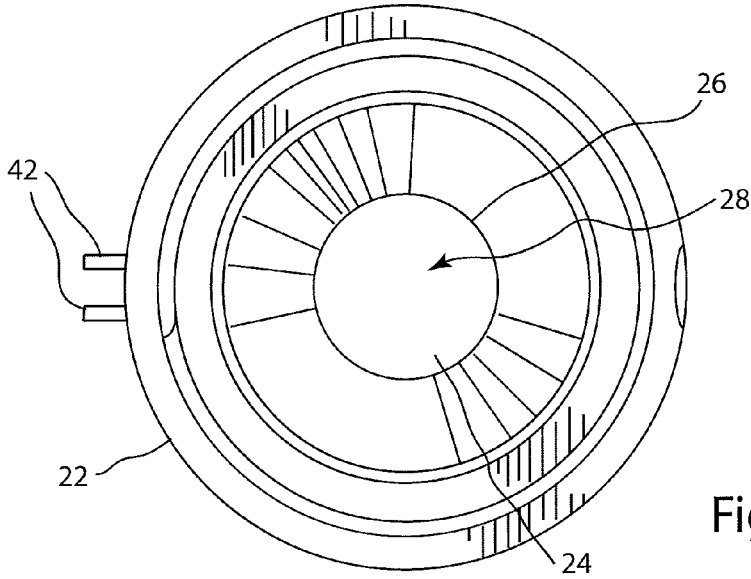
FIG. 5 is a plan view of the base of the closure of FIGS. 2*a* and 2*b*, viewed from above.
Figure 6:
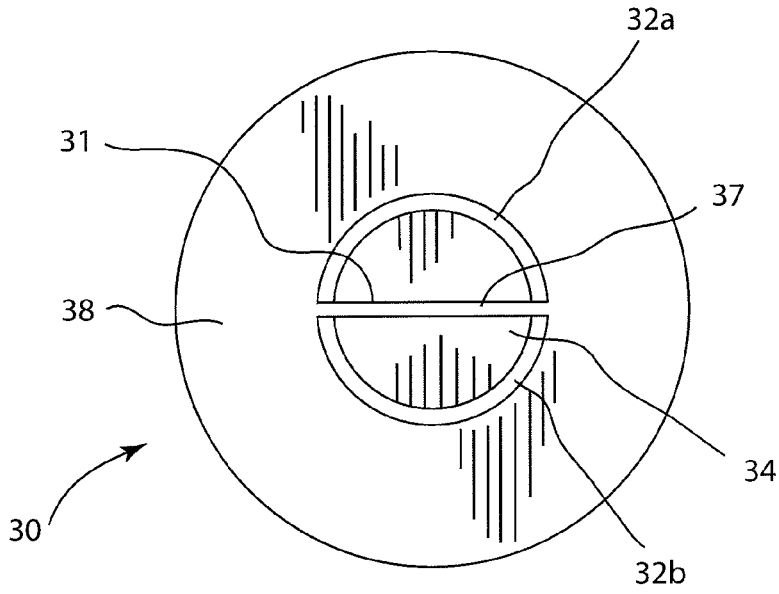
FIG. 6 is a plan view of an annular ring and valve of the dispensing closure, shown in FIGS. 2*a* and 2*b*, viewed from below.
Figure 7:
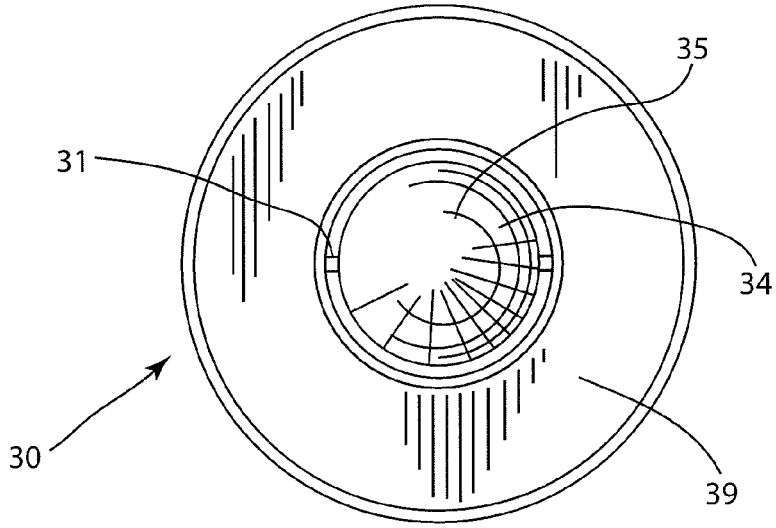
FIG. 7 is the annular ring and valve of FIGS. 2*a* and 2*b*, viewed from above.
Figure 8:
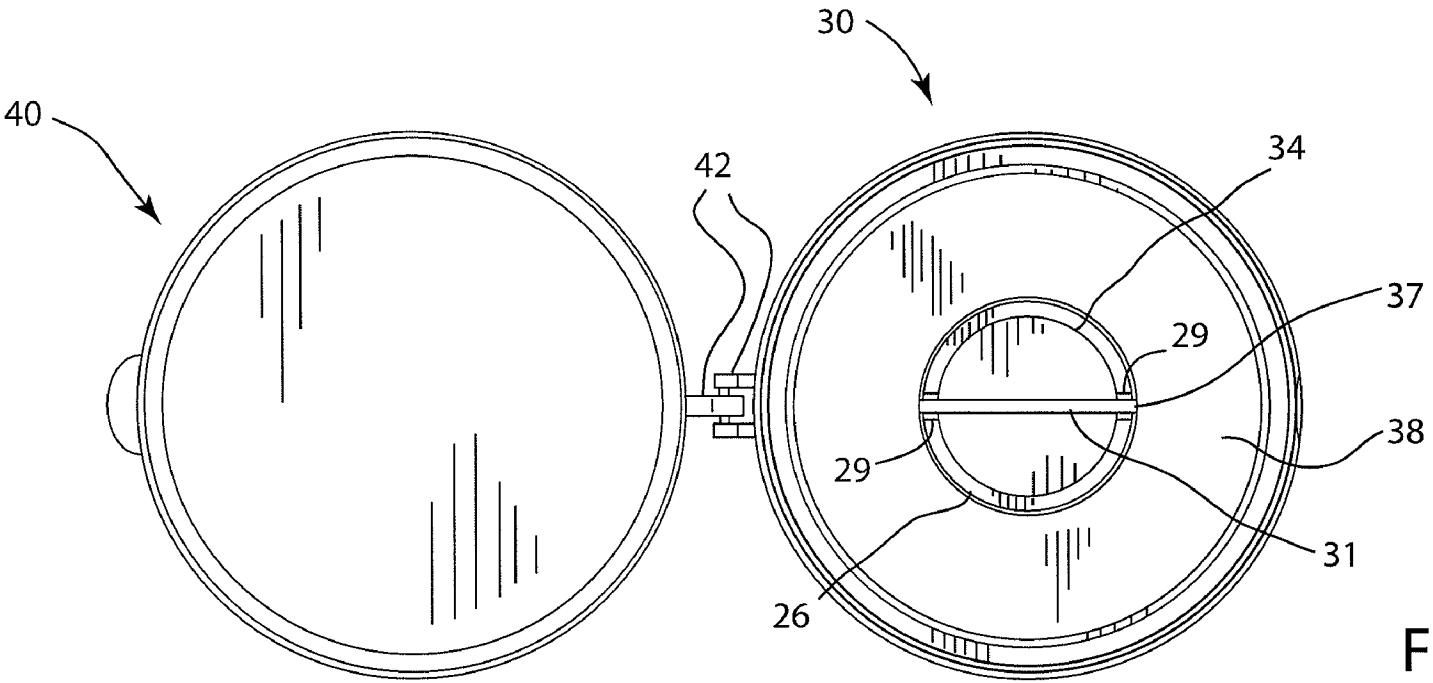
FIG. 8 is a plan view of the container of FIG. 1*b;*

Referring now to FIGS. 6 and 7, along with FIG. 3, the closure 20 comprises an annular ring 30. The annular ring 30 comprises a transverse member 31 which divides the annular ring aperture into apertures 32*a* and 32*b*. Outwardly facing surface 37 of bar 31 is flush with exterior facing surface 38 which forms the top of annular ring 30. Member 33 extends from the transverse member 31 to a valve in the form of plug 34. Plug 34 has an angled or conical surface 35. The widest portion of plug 34 has a width 36 which is slightly larger than the diameter of spout 26 so that the plug 34 can be press fit through spout 26.

A spring 50 is disposed between the annular ring 30 and the base 22 of the closure 20. Specifically, the spring 50 is in contact with uppermost inner facing surface 39 of the wall of the annular ring 30. In its assembled form, the annular ring 30 fits over and is disposed around the spout 26 with the plug 34 disposed in the bore formed by spout 26 and spout 26 extending up from a top surface of annular ring 30. The spring 50 biases the annular ring 30 so as to force the plug 34 to its closed position, completely closing the opening 28. The transverse member 31 is disposed in the pair of channels 29 and slides within the channels 29 when the annular ring 30 is depressed inward towards the base 22 against the biasing force of spring 50.

Advantageously, exterior wall surface 52 of annular ring 30 abuts interior facing wall surface 54 of base 22, forming a bearing surface therebetween. The bearing surface between the annular ring 30 and the base 22 resists rotation of the annular ring 30 about any horizontal axis relative to the base 22.

Figure 2A:
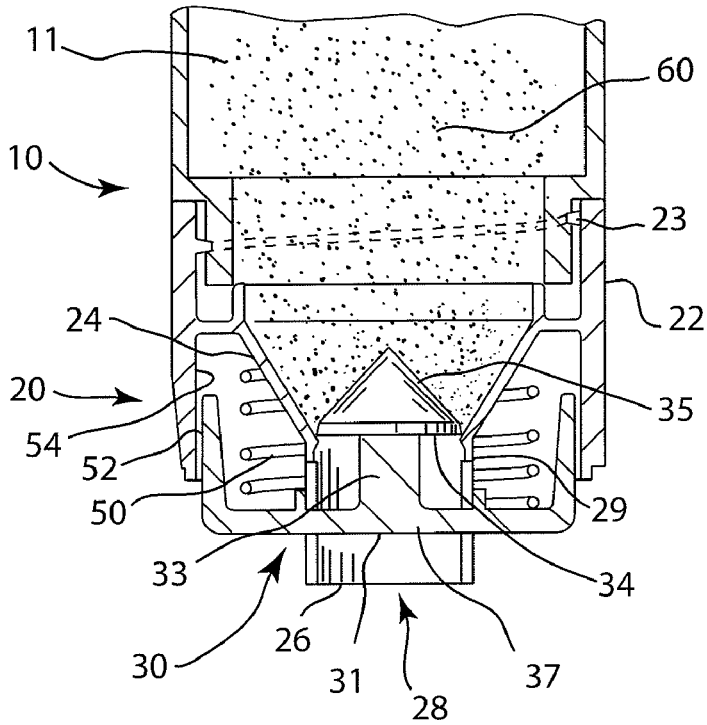
FIG. 2*a* is a cross-sectional view of the container of FIG. 1*b* inverted 180° and taken along line 2*a,b*-2*a,b* of FIG. 1*b*, shown in a closed configuration, in accordance with the present invention.
Figure 2B:
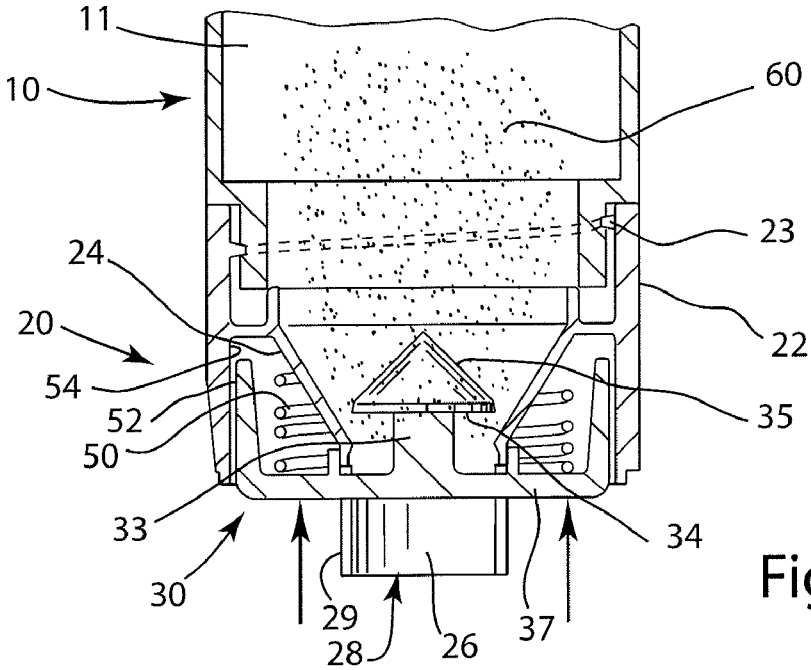
FIG. 2*b* is a cross-sectional view of the container of FIG. 1*b*, inverted 180° and shown with a valve in an open position, in accordance with the present invention.

Referring now to FIGS. 2*a* and 2*b*, which depict closure 20 in its closed position, spring 50 biases the annular ring 30 to force the plug 34 to completely cover the entrance to the spout 26. As a result, the contents 60, in the form of a powder, are prevented from entering the spout 26, and thus prevented from exiting the opening 28.

The annular ring 30 acts as an actuator, whereby pressing the annular ring 30 inward towards the container body 11 forces the plug 34 inward and away from the entrance to spout 26, as shown by the arrows in FIG. 2*b*. As a result, powder 60 can enter spout 26 and exit out of opening 28 and on through annular apertures 32*a*, 32*b*.

Figure 9A:
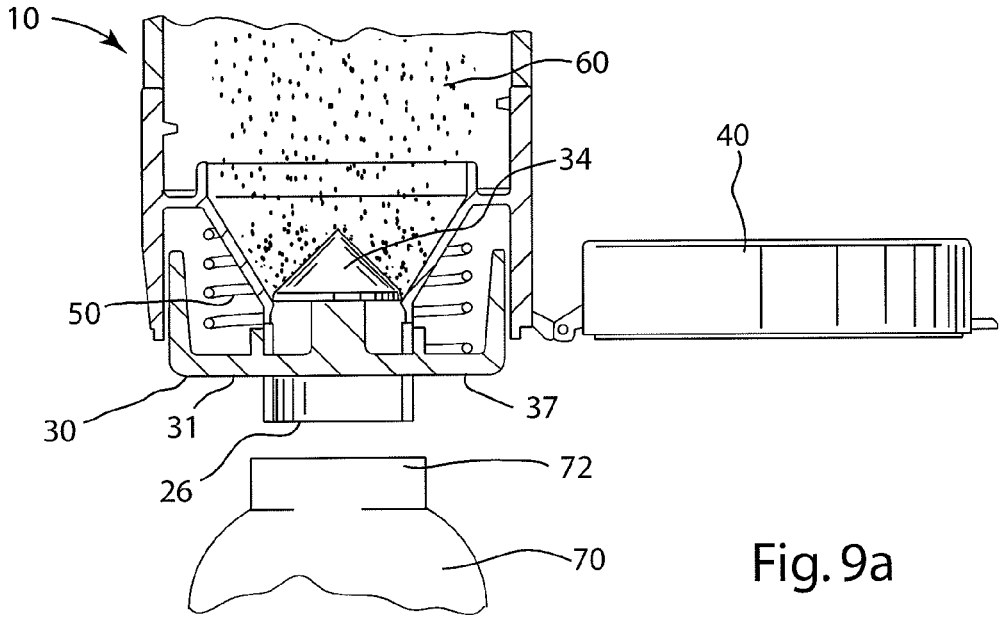
FIG. 9*a* is a partial cross-section of the container of FIGS. 2*a* and 2*b*, shown in the closed position over a drinking bottle, in accordance with the present invention.
Figure 9B:
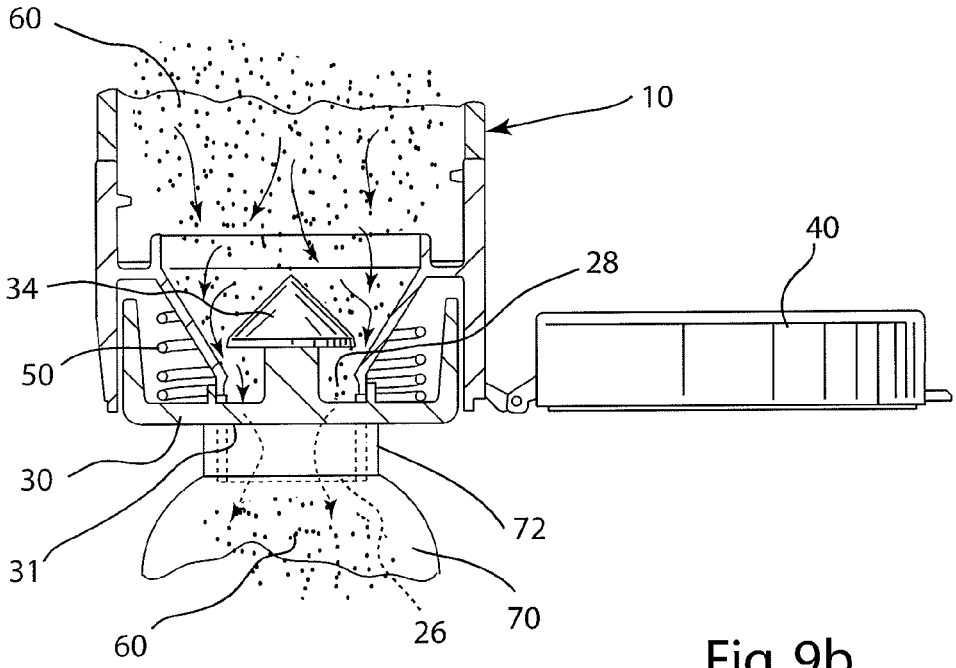
FIG. 9*b* is a partial cross-section of the container and bottle of FIG. 9*a*, shown in the opened position, in accordance with the present invention.

Referring now to FIGS. 9*a* and 9*b*, the container 10 can be used to dispense a powder 60, which is disposed in the container body 11, to a liquid container, such as a drinking bottle 70. First, a user inverts the container 10 so that the annular ring 30 is facing downward over the mouth of the bottle 70 disposed therebelow. Subsequently, the user rests the annular ring 30 over the mouth 72 with the annular apertures 32*a*, 32*b* completely over the mouth 72 with the spout 26 extending into the bottle 70. Having the spout 26 extend from a top surface of the annular ring 30 helps ensure that the opening of the container 10 will be completely over the mouth of the bottle 70 when dispensing the powder 60. Subsequently, the user presses downward on the container 10, thereby pressing the annular ring 30 inward towards the center of container 10, and thereby actuating the plug 34 to move inwardly towards the container body 11, as shown in FIG. 9*b*. Consequently, the plug 34 is moved inwardly away from the entrance of spout 26. As a result, powder 60 is able to flow continuously from container body 11, over the top and around the annular angled surface 35 of plug 34, along the angled surface of wall 24, into spout 26, out opening 28, on through the annular apertures 32*a*, 32*b* and into the bottle 70 disposed therebelow. Withdrawing the container 10 from bottle 70 results in the annular ring 30 with plug 34 being forced back to its original position due to the biasing force of spring 50, thereby closing the opening 28 by returning to its original closed position at the entrance of spout 26, as shown in FIGS. 2*a* and 9*a*. As a result, powder 60 can no longer flow from container body 11 and out opening 28. Therefore, one can now remove the container 10 from the top of the bottle 70 without additional powder 60 flowing from the container 10.

Figure 10:
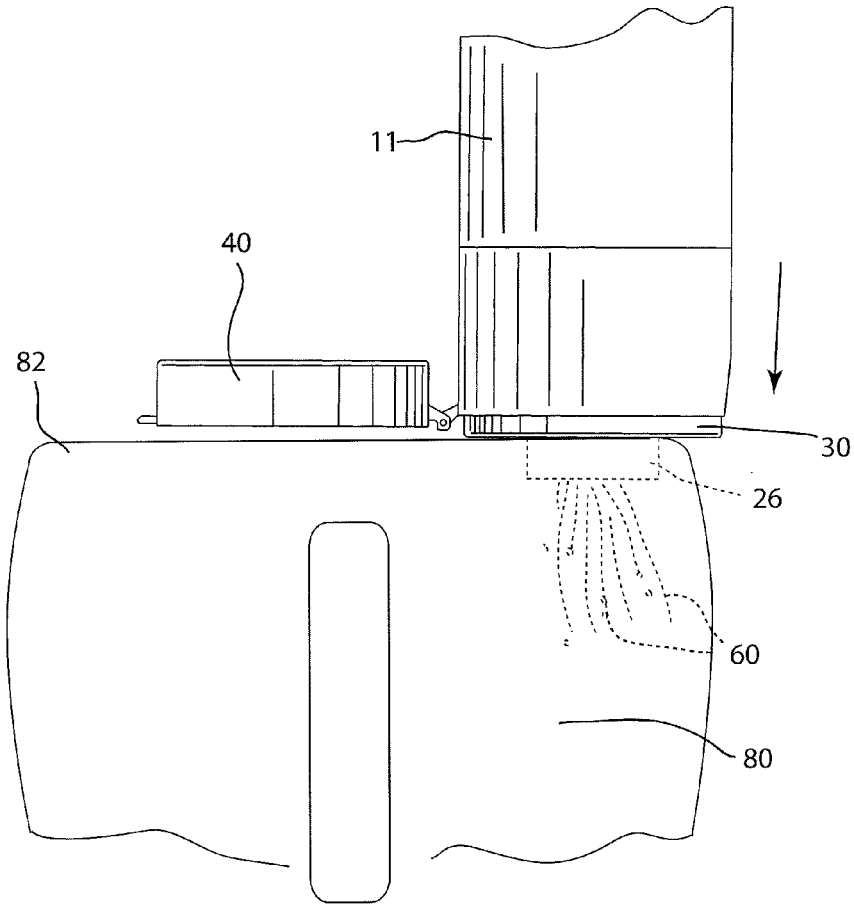
FIG. 10 is a partial cross-section of the container of FIG. 1*b*, shown in an open position over a liquid container, in accordance with the present invention.

Referring now to FIG. 10, container 10 can be used to dispense a powder into other liquid containers, such as glass 80. In order to dispense powder 60 into glass 80, first, one inverts container 10 and rests the annular ring 30 on the mouth 82. Subsequently, the user presses downward on the container 10, thereby forcing the annular ring 30 inward towards the center of container 10, thereby moving plug 34 inward and allowing the flow of powder 60 from the container body 11, through apertures 32*a*, 32*b* and into glass 80, as shown in FIG. 10. Since the apertures 32*a*, 32*b* are completely over the mouth 82, all of the powder 60 dispensed will go directly into the glass 80 disposed therebelow. As noted, having spout 26 extend from the annular ring 30 helps ensure that apertures 32*a*, 32*b* are completely over the mouth 82.

It will now be apparent to one of ordinary skill in the art that container 10 can be used to dispense a powder into an appropriate liquid container, including different sizes of glasses, bottles and pitchers.

The present closure 20 can be used to meter the amount of powder which is dispensed. By knowing the flow rate (the amount of time it takes for a predetermined amount of powder to be dispensed through the opening), one can meter the amount of powder that is dispensed by timing how long the powder is dispensed. Using the flow rate, one can dispense the powder for a predetermined amount of time which is correlated to a desired quantity. For example, a flow time of two seconds may be correlated to the amount of powder needed for a 0.5 liter beverage and a flow time of four seconds may be correlated to the amount of powder needed for a 1 liter beverage.

It will now be clear to one of ordinary skill in the art that the present dispenser has features and advantages over prior dispensers for powdered beverages. The present invention allows for controlled dispensing of a powder into a bottle without spilling the powder, since the powder can only be dispensed when the container is over the mouth of a bottle and the container is depressed to start the flow of the powder. The flow stops when the container is removed from the top of the bottle. In addition, the present dispenser allows for metering a controlled amount of powder which is dispensed by knowing the flow rate and timing how long the powder is dispensed into a bottle or other vessel disposed below. As a result, the present dispenser dispenses a desired amount of powdered beverage depending on the vessel, e.g., bottle, glass or pitcher to which the powder is being dispensed. Consequently, the present container can be used to dispense the exact amount of powder that is needed into whatever size vessel one wishes.

It may at times be convenient to describe the container and its dispensing device in its upside down, inverted position wherein, for example, the normal "top" of the container may be referred to as the "bottom" of the container.

Although the invention has been described above in relation to preferred embodiments thereof, it will be understood by those skilled in the art that variations and modifications can be effected in these preferred embodiments without departing from the scope and spirit of the invention.

The invention claimed is:

1. A container having a dispensing device comprising, when the container is in an inverted position, a body portion for containing the contents of the container, the body portion having a discharge opening at the lower end thereof, a spout extending downwardly from the discharge opening and open at its lower end, an annular ring having an outer portion which encircles the spout and an inner portion which has at least one aperture therethrough, the annular ring being movable upwardly and downwardly along the exterior of the spout, the annular ring connected to a valve member which has a closed position at which it blocks off the flow of the contents of the container downwardly through the discharge opening, and an open position at which the valve permits the contents of the container to flow downwardly out of the discharge opening and through the at least one aperture, a resilient member biasing the annular ring to move downwardly along the spout to move the valve member to its closed condition, and wherein compression of the resilient member moves the annular ring upwardly to move the valve member to its open position.

2. A container according to claim 1, wherein the lower end of the body portion comprises an inwardly tapered conical portion, and the discharge opening is located at the lower end of the conical portion.

3. A container according to claim 1, wherein the valve member is located in the body portion.

4. A container according to claim 1, wherein the lower end of the body portion comprises an inwardly tapered conical portion, the discharge opening is located at the lower end of the conical portion and the valve member is located within the conical portion.

5. A container according to claim 1, wherein the inner portion of the annular ring has a transverse member spanning the central portion and defining on each side thereof an aperture, and the valve being attached to the transverse member.

6. A container according to claim 5, further comprising a stop which limits the distance that the annular member can move upwardly along the spout.

7. A container according to claim 5, wherein the annular ring outer portion has a downwardly facing surface, and the transverse member has a downwardly facing surface which is flush with said downwardly facing surface of the outer portion.

8. A container according to claim 1, further comprising a removable cap disposed on the annular ring and positioned to prevent upward movement of the annular ring when the cap is in its position covering the annular ring.

9. A container according to claim 1, further comprising a removable cap which provides a moisture seal over the open end of the spout to thereby protect the contents of the container from moisture.

10. A container according to claim 1, wherein the annular ring has an exterior wall, and the container has an interior facing surface which engages the said exterior wall and forms a bearing surface therewith.

11. A container according to claim 1, wherein the resilient member is a spring which is in contact with an inwardly facing surface of the outer portion of the annular ring.

12. A container according to claim 1, further comprising a flowable powder disposed within the container.

13. A container according to claim 12, wherein the flowable powder is a powdered drink mix.

14. A container according to claim 1, wherein the container is handheld, palm sized.

15. A container according to claim 14, wherein the container is in the shape of a cylinder.

16. A container according to claim 1, wherein the container is one to ten inches in height and has a maximum width of one to four inches.

17. A method for dispensing contents from a container into a vessel, which container has a dispensing opening and a depressible actuator attached to a valve which opens and closes the dispensing opening, comprising the steps of:

inverting the container such that the dispensing opening faces downwardly, determining the flow rate of the contents of the container through the dispensing opening based on the size of the dispensing opening and the flow characteristics of the contents, depressing the depressible actuator upwardly to move the valve to open the dispensing opening to permit the downward flow of the contents from the container through the dispensing opening, and dispensing the contents of the container into the vessel by keeping the dispensing opening open for a certain time based on the predetermined flow characteristics of the contents in order to dispense a predetermined quantity of the contents.

18. A method according to claim 17, wherein the receptacle includes a liquid, the composition of which is desirably altered in a desired way by the introduction of the predetermined quantity of the contents of the container.

19. A method according to claim 18, wherein the powdered contents is a powdered drink mix and the desired way is to achieve a drink with desired properties.

20. A method according to claim 17, wherein the step of dispensing the contents of the container comprises timing how long the contents are dispensed from the container and correlating said time with the quantity of the contents dispensed.

21. A method according to claim 17, wherein the step of depressing the actuator comprises pressing the actuator onto the mouth of the vessel so that the contents flow out of the container and into the vessel below.

22. A method according to claim 17, wherein the step of inverting a container comprises turning upside down a container which has a spout which, in the inverted position, extends downwardly, is open at its lower end and which is surrounded by an outer portion of an annular ring which has a central opening therethrough such that the bottom of the spout extends into the vessel.

23. A method according to claim 22, including, when the mouth of the spout is located in the vessel, pressing the actuator with the top of the vessel to move the actuator upwardly to allow flow of the contents out of the container and into the vessel.

24. A dispensing device for a container, said dispensing device comprising:

an opening of the container;

an annular ring having a central portion with at least one aperture, the annular ring attached to a valve dimensioned to close the opening, said valve having a top surface and a side surface, said valve operatively associated with the opening and biased in a closed position, wherein depressing the annular ring causes the valve to move inwardly, into the container and away from the opening, thereby allowing a continuous flow of the contents to be dispensed from the container, flowing over the top surface of the valve, and through the at least one aperture of the annular ring, and wherein the opening of the container is formed by a mouth of the container and the annular ring surrounds the opening, wherein when the annular ring is depressed inwardly, the annular ring slides down around the mouth of the container, thereby exposing the mouth of the container.

25. The dispensing device according to claim 24, wherein the mouth of the container comprises a pair of channels and the annular ring comprises a transverse member spanning the central portion of the annular ring, wherein the transverse member is disposed in the pair of channels of the mouth of the container.

26. A dispensing device for a container, said dispensing device comprising:

an opening of the container;

an annular ring having a central portion with at least one aperture, the annular ring attached to a valve dimensioned to close the opening, said valve having a top surface and a side surface, said valve operatively associated with the opening and biased in a closed position, wherein depressing the annular ring causes the valve to move inwardly, into the container and away from the opening, thereby allowing a continuous flow of the contents to be dispensed from the container, flowing over the top surface of the valve, and through the at least one aperture of the annular ring, and wherein the opening of the container comprises a spout which extends up through the annular ring when the valve is in both the closed position and the open position.

* * * * *